US006097362A

United States Patent [19]

Kim

[11] Patent Number: 6,097,362

[45] Date of Patent: Aug. 1, 2000

[54] DRIVER FOR LIQUID CRYSTAL DISPLAY

[75] Inventor: An Young Kim, Kyungsangbuk-do, Rep. of Korea

[73] Assignee: LG Semicon Co., Ltd., Chungcheongbuk-Do, Rep. of Korea

[21] Appl. No.: 09/088,378

[22] Filed: Jun. 2, 1998

[30] Foreign Application Priority Data

Oct. 14, 1997 [KR] Rep. of Korea ..... 97-52585

[51] Int. Cl.[7] ..... G09G 3/36

[52] U.S. Cl. ..... 345/87; 345/98; 345/100; 345/204

[58] Field of Search ..... 345/87, 88, 98, 345/100, 155, 204

[56] References Cited

U.S. PATENT DOCUMENTS 5,426,447 6/1995 Lee ..... 345/103
5,572,211 11/1996 Erhart et al. ..... 341/144
5,578,957 11/1996 Erhart et al. ..... 327/333
6,008,801 12/1999 Jeong ..... 345/204

*Primary Examiner*—Steven J. Saras
*Assistant Examiner*—Fritz Alphonse
*Attorney, Agent, or Firm*—Morgan, Lewis & Bockius LLP

[57] ABSTRACT

A liquid crystal display driver includes a shift register for shifting stored R, G and B data and outputting load signals, a first latch having a plurality of channels for holding and outputting the R, G and B data, a bit converter for converting a number of bits of each R, G and B data outputted from the first latch, a multiplexer for selectively passing voltages outputted by the bit converter upon application of the load signals outputted by the shift register, a decoder for selecting and sequentially outputting an externally supplied voltage in response to an output of the multiplexer, a demultiplexer for demultiplexing output signals of the decoder upon application of the load signals, a second latch for storing and outputting output signals of the demultiplexer,and an output buffer for transmitting output signals of the second latch to a liquid crystal display panel.

19 Claims, 5 Drawing Sheets

DRIVER FOR LIQUID CRYSTAL DISPLAY

This application claims the benefit of Korean Patent Application No. 52585/1997, filed Oct. 14, 1997, which is hereby incorporated by reference.

BACKGROUND OF THE INVENTION

1. Field of the Invention

The present invention relates to a liquid crystal display (LCD), and more particularly, to an LCD driver which has a digital to analog converter (DAC) requiring a plurality of channels.

2. Discussion of the Related Art

A digital to analog converter (DAC) is one of the most important components of a source driver of a thin film transistor (TFT) LCD. A DAC produces an analog output voltage in response to applied digital data. The DAC includes decoder switches selectively outputting one of a plurality of input voltages corresponding to applied data. The DAC has 64 analog switches and 64 decoders in order to select one of input voltages corresponding to the applied data to indicate one of 64 gray levels. Thus, for example, for an 80-pixel color line there are 240 output channels, 64×240 analog switches are required, and the 64 input voltages are connected to each analog switch.

A conventional LCD driver will now be described.

FIG. 1 is a block diagram of the conventional LCD driver.

As shown in FIG. 1, the conventional LCD driver includes a shift register 11 for shifting stored R, G, and B data. A first latch 13 stores the R. G and B data sequentially. A second latch 15 holds one line of R, G and B data, stored in the first latch 13 upon application of load signals LP1 through LP80 from the shift register 11. The shift register is 80 bits wide in this example. A bit converter 17 converts the R, G and B data, which is 6-bits, to 13 bit data. A decoder 19 outputs an analog voltage for each channel of the bit converter 17. An output buffer 21 receives analog voltages outputted from the decoder 19 and transmitting them to an LCD panel.

Each of the R, G and B data is 6-bits wide, and there are 240 channels in this example. The first latch 13 stores the R, G and B data in the first channel to the 240th channel in the order of R, G and B. The second latch 15 loads the R, G and B data one line at a time from the first latch 13, and when the load control signal is applied to the second latch 15, the second latch 15 outputs the R, G and B data to the bit converter 17. The bit converter 17 converts 6-bit data to 13-bit data, corresponding to converting voltages in a range of 0 to 5V to voltages in a range of 0 to 12V. Each channel has data corresponding to the voltage in the range of 0 to 12V. Thus, the decoder 19 selectively outputs one of the 128 inputted analog voltages corresponding to each channel.

The operation of the conventional LCD driver will now be described.

As shown in FIG. 1, the shift register 11 determines whether the R, G and B data will be shifted to the left or right, upon application of an input/output control signal. That is, the shift register 11 determines whether it shifts the R, G and B data either in its 1st shift to the 80th shift or in the 80th shift to the 1st shift. The R, G and B data are sequentially stored in the first latch 13 on determination of whether the shift is to the left or right. The first latch 13 includes 240 channels, and one of the R, G and B data is stored sequentially in each channel. The second latch 15 stores the R, G and B data, stored in the first latch 13, wherein the R, G and B data correspond to an 80-pixel color line on the LCD panel.

When the load control signal is applied to the second latch 15, the second latch 15 outputs the R, G and B data to the bit converter 17. The bit converter 17 converts the 6-bit data to the 13-bit data for each channel voltages in the range of 0 to 5V to the voltages in the range of 0 to 12V. Accordingly, the 6-bit data outputted from each channel becomes the 13-bit data to correspond to the voltage range of 0 to 12V.

If the decoder 19 receives the 128 analog voltages from an R-ladder, it outputs a voltage, equivalent to the voltage level of each channel, to an output buffer 21. Thus, the output buffer 21 outputs one of the 128 analog voltages for each channel, transmitting the voltage to the LCD panel.

The conventional LCD driver requires one DAC for each channel, resulting in an increase in an overall size and complexity of the driver.

SUMMARY OF THE INVENTION

Accordingly, the present invention is directed to a driver for a liquid crystal display that substantially obviates one or more of the problems due to limitations and disadvantages of the related art.

An object of the present invention is to provide a driver for a liquid crystal display with a DAC whose size and complexity are reduced, thereby minimizing power consumption.

Additional features and advantages of the invention will be set forth in the description which follows, and in part will be apparent from the description, or may be learned by practice of the invention. The objectives and other advantages of the invention will be realized and attained by the structure particularly pointed out in the written description and claims as well as the appended drawings.

To achieve these and other advantages and according to the purpose of the present invention, as embodied and broadly described, in one aspect of the present invention there is provided a liquid crystal display driver, including a shift register for shifting stored R, G and B data and outputting load signals, a first latch having a plurality of channels for holding and outputting the R, G and B data, a bit converter for converting a number of bits of each R, G and B data outputted from the first latch, a multiplexer for selectively passing voltages outputted by the bit converter upon application of the load signals outputted by the shift register, a decoder for selecting and sequentially outputting an externally supplied voltage in response to an output of the multiplexer, a demultiplexer for demultiplexing output signals of the decoder upon application of the load signals, a second latch for storing and outputting output signals of the demultiplexer,and an output buffer for transmitting output signals of the second latch to a liquid crystal display panel.

In another aspect of the present invention there is provided a liquid crystal display driver, including a shift register outputting a plurality of load signals, a first latch having a plurality of channels for loading R, G and B data into a corresponding one of the plurality of channels upon application of one of the plurality of load signals, a bit converter for converting a number of bits of the R, G and B data of the plurality of channels inputted from the first latch upon application of one of the plurality of load signals and having a corresponding plurality of bit converter outputs, a multiplexer for multiplexing the plurality of bit converter outputs and having a first multiplexer output corresponding to the R data, a second multiplexer output corresponding to the G data, and a third multiplexer output corresponding to the B data, a decoder for outputting a first analog voltage corresponding to the first multiplexer output, a second analog voltage corresponding to the second multiplexer output, and a third analog voltage corresponding to the third multiplexer output, a demultiplexer for demultiplexing the first, second, and third analog voltages upon application of the plurality of load signals and having a plurality of demultiplexer outputs, and a second latch for storing the plurality of demultiplexer outputs.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Reference will now be made in detail to the preferred embodiments of the present invention, examples of which are illustrated in the accompanying drawings.

Figure 1:
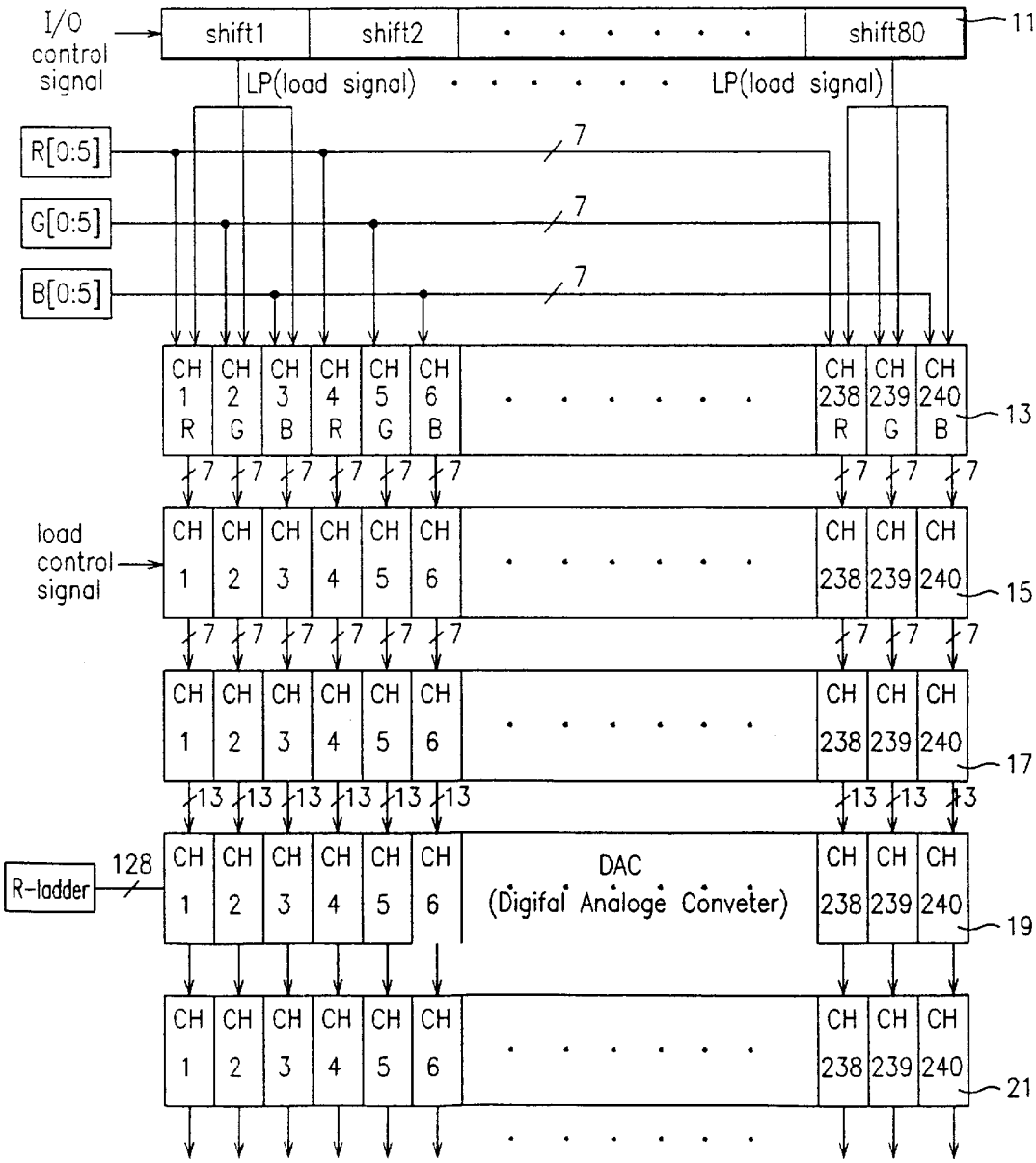
FIG.1 prior art
FIG. 1 is a block diagram of a conventional LCD driver.
Figure 2:
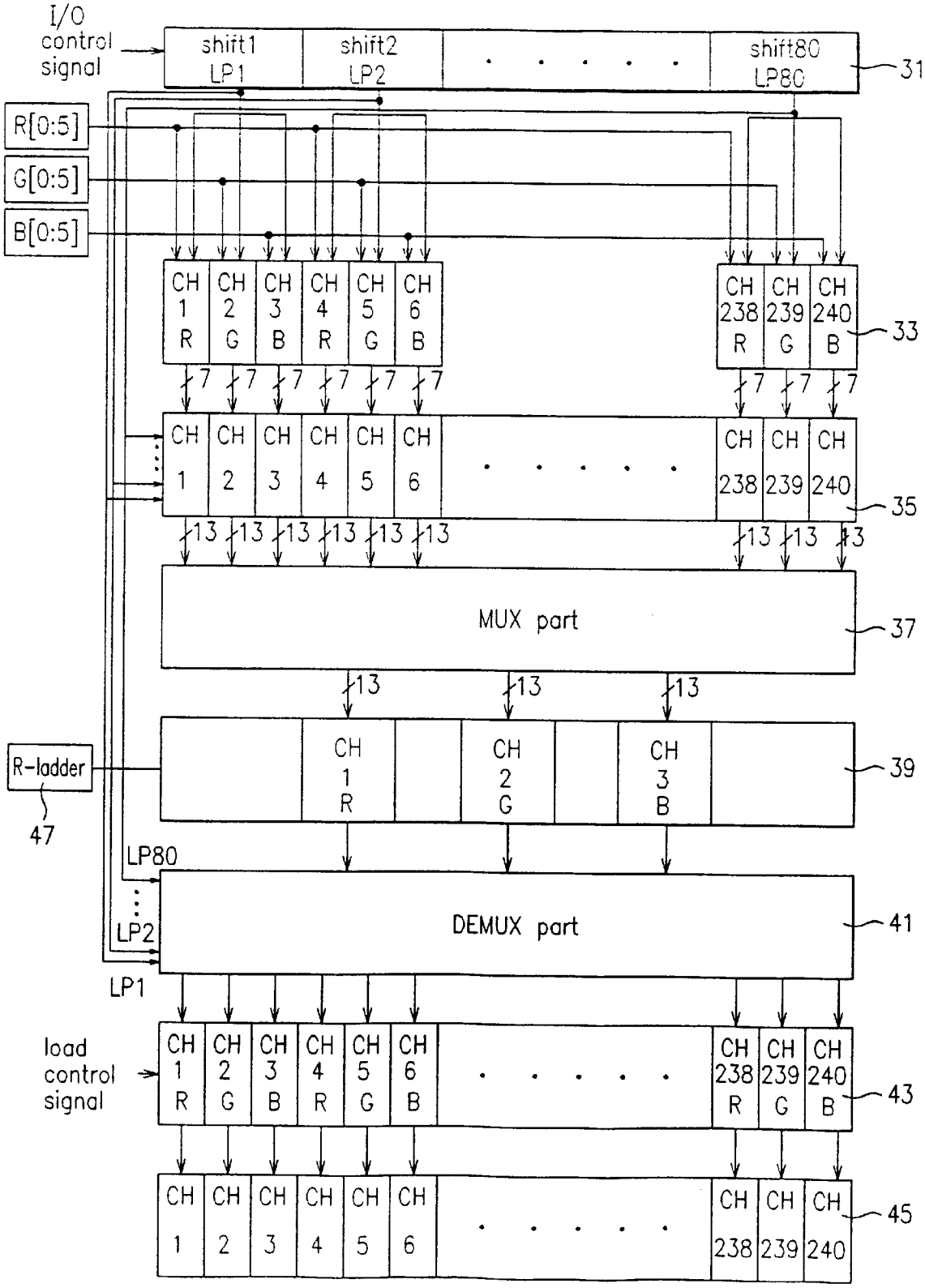
FIG. 2 is a block diagram of an LCD driver according to the present invention.

FIG. 2 is a block diagram of an LCD driver according to the present invention. As shown in FIG. 2, the LCD driver includes a shift register 31 for shifting inputted data; a first latch 33 for sequentially storing red (R), green (G) and blue (B) data sequentially; a bit converter 35 for shifting a voltage level of each data outputted from the first latch 33; a multiplexer (MUX) 37 for selectively passing a voltage outputted from the bit converter 35 on application of load signals LP1 to LP80 outputted by the shift register 31; a decoder 39 for selectively outputting one of the 128 analog voltages supplied by an R-ladder and corresponding to output of the multiplexer 37; a demultiplexer (DEMUX) 41 for receiving and demultiplexing each output of the decoder 39; a second latch 43 for receiving analog voltages sequentially outputted by the DEMUX 41 and simultaneously outputting them; and an output buffer 45 for transmitting each analog voltage stored in the second latch 43 to an LCD panel.

An R-ladder 47 outputs the 128 analog voltages to the decoder 39.

The decoder 39 selects one of the 128 analog voltages inputted from the R-ladder 47 in response to each output of the MUX 37, and outputs it to the DEMUX 41. The DEMUX 41 sequentially demultiplexes output voltages of the decoder 39. The shift register 31 determines whether it shifts the R, G and B data to the left or right of the first latch 33, and outputs the load signals LP1 to LP80 to the first latch 33, the MUX 37 and the DEMUX 41. The shift register 31 includes shift 1 to shift 80. The first latch 33 stores the R, G and B data upon application of the load signals LP1 to LP80 from the shift 1 to the shift 80.

The R, G and B data corresponding to a first pixel are stored in channels 1, 2 and 3 of the first latch 33 on receipt of the load signal LP1 from the shift 1. The R, G and B data corresponding to a second pixel are stored in channels 4, 5, 6 on application of the load signal LP2 from the shift 2, and so on. Therefore, the first latch 33 stores the R, G and B data in its 240 channels in response to the load signals LP1 to LP80, which are sequentially outputted by the shift register 31. The bit converter 35 converts the number of bits of the inputted data from 6 bits to 13 bits, corresponding to a convertion of analog voltages from the range of 0 to 5V to voltages in the range of 0 to 12V, on receipt of the R, G and B data from the first latch 33.

Figure 3:
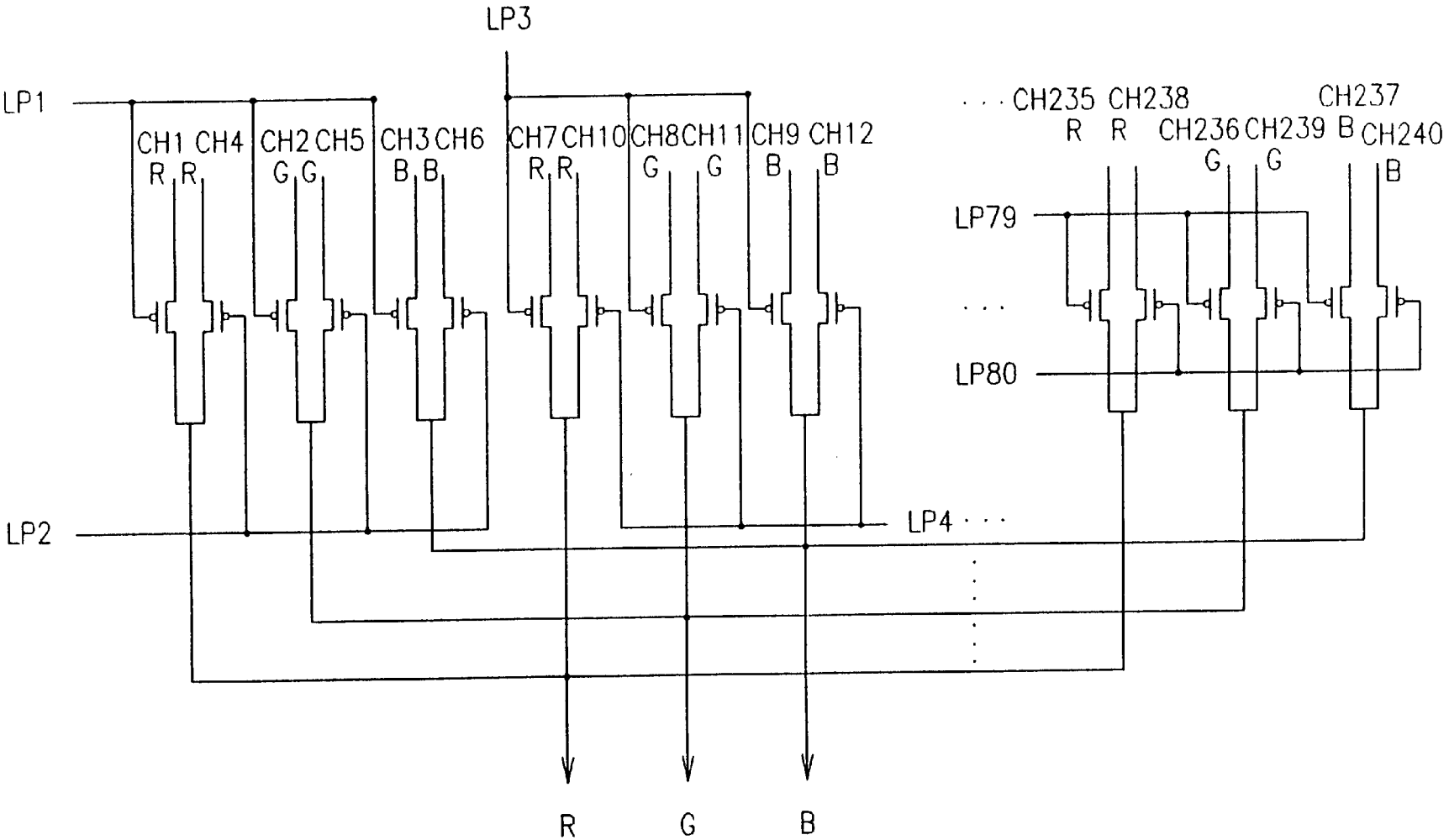
FIG. 3 is a circuit diagram of a multiplexer of the LCD driver of the present invention.

FIG. 3 is a circuit diagram of the MUX 37 of the LCD driver. The MUX 37 passes output voltages of the bit converter 35 to the decoder 39. The bit converter 35 stores data in the channels 1 to 240 in the order of the R, G and B data. The channels 1, 4, 7, 10, . . . , and 238 store the R data. The channels 2, 5, 8, . . . , 239 store the G data. The channels 3, 6, . . . , and 240 store the B data.

The MUX 37 includes switching devices 51-1 to 51-240 connected to each channel, and one of two channels is selected for a pair of the switching devices 51-1 to 51-240. As shown in FIG. 3, the MUX 37 includes 120 pairs of the switching devices 51-1 to 51-240, pairing the bit converter 35's channels 1 and 4, channels 2 and 5, . . . , and channels 237 and 240. The switching devices 51-1 to 51-240 are enabled sequentially upon application of the load signals LP1 to LP 80. The switching devices 51-1, 51-2 and 51-3 are connected to the channels 1, 2 and 3 of the bit converter 35 and are enabled by application of the load signal LP1. The switching devices 51-4, 51-5 and 51-6 are connected to the channels 4, 5 and 6, respectively, and are enabled by the load signal LP2. The switching devices 51-235, 51-236 and 51-237 are connected to the channels 235, 236 and 237, respectively, and are enabled by the output load signal LP79. The switching devices 51-238, 51-239 and 51-240 are coupled to the channels 238, 239 and 240, respectively, and are enabled by the load signal LP80. In other words, the first and fourth channels form an adjacent pair of channels having the R data applied to them. The seventh and tenth channels form an adjacent pair of channels having the R data applied to them. The thirteenth and sixteenth channels form an adjacent pair of channels having the R data applied to them, etc. The second and fifth channels form an adjacent pair of channels having the G data applied to them. The eighth and eleventh channels form an adjacent pair of channels having the G data applied to them, etc. The third and sixth channels form an adjacent pair of channels having the B data applied to them. The ninth and twelfth channels form an adjacent pair of channels having the B data applied to them, etc. In this manner, the channels, and their corresponding adjacent pairs of switching devices are interlaced, as shown in FIG. 3.

The MUX 37 sequentially outputs the R, G and B data stored in the channels 1 to 240 to the decoder 39 through its three output terminals $T_R$, $T_G$ and $T_B$ upon application of the load signals LP1 to LP80.

Figure 4:
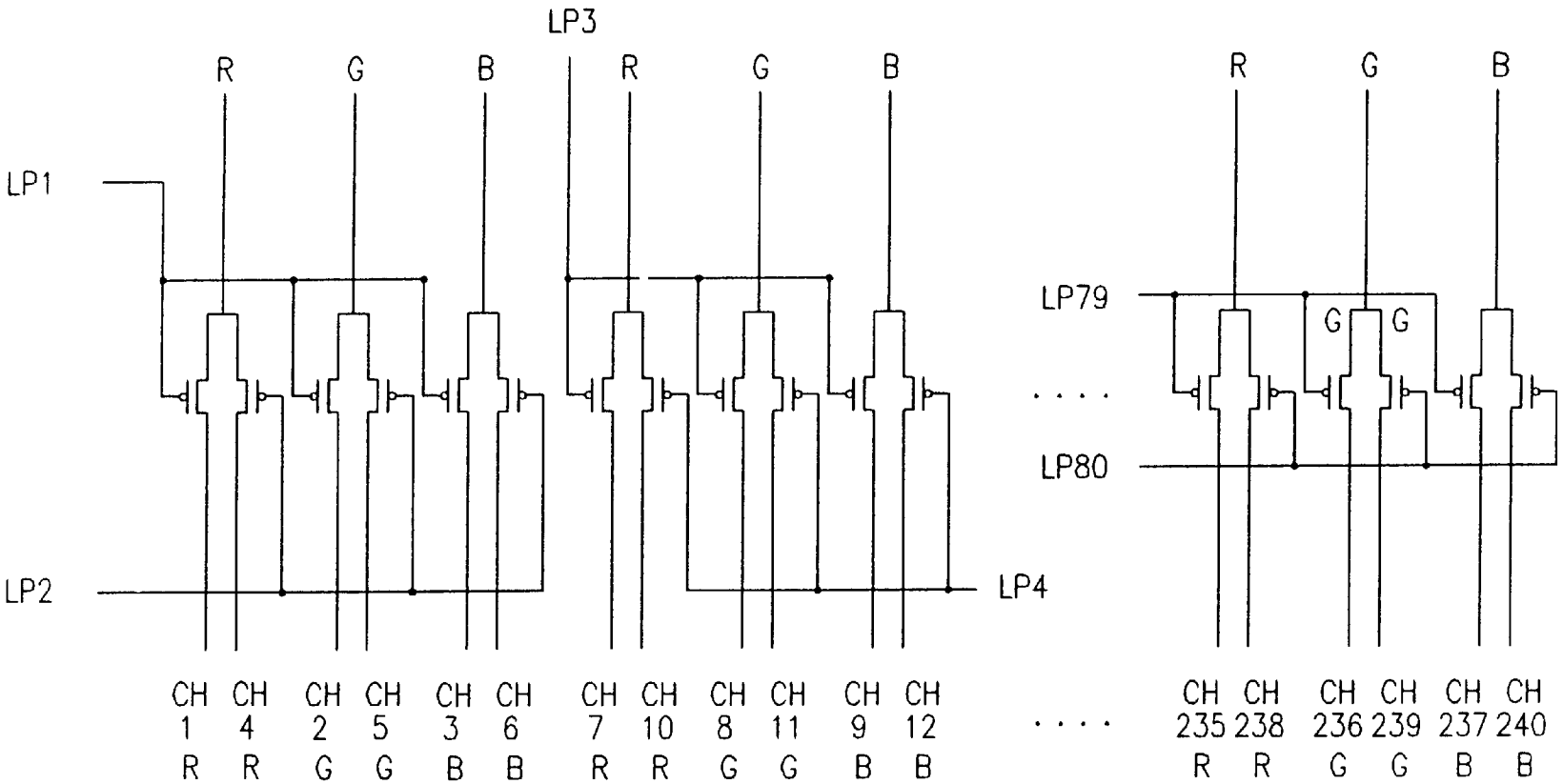
FIG. 4 is a circuit diagram of a demultiplexer of the LCD driver of the present invention.

Referring to FIG. 4, the DEMUX 41 includes 120 pairs of switching devices 61-1 to 61-240, which may be P-metal oxide semiconductor (P-MOS) transistors or N-MOS transistors. The switching devices 51-1 to 51-240 are sequentially enabled by the load signals LP1 to LP80, thus demultiplexing outputs of the decoder 39. The demultiplexing is performed upon application of load signals LP1 to LP80.

Figure 5:
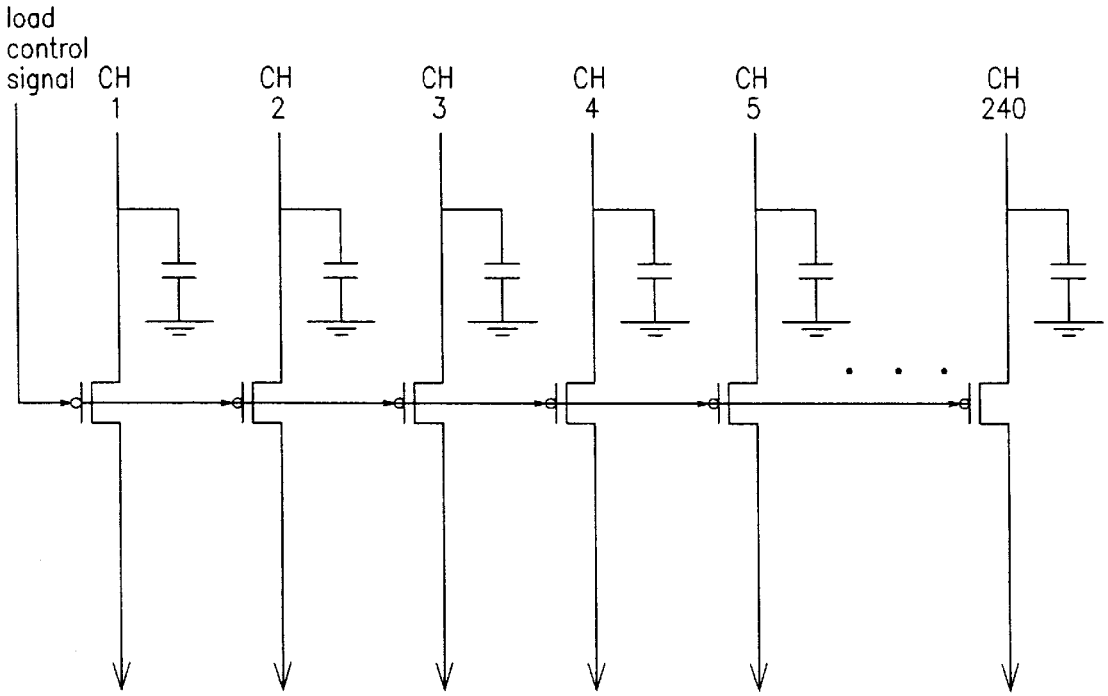
FIG. 5 is a circuit diagram of a second latch of the LCD driver of the present invention.

FIG. 5 schematically depicts the second latch 43 of the LCD driver. As shown in FIG. 5, the second latch 43 includes 240 MOS transistors 71-1 to 71-240 that function as switching devices, and capacitors C1 to C240 for storing the outputs of the DEMUX 41. Each capacitor is connected in parallel to a corresponding input terminal of each MOS transistor 71-1 to 71-240. The second latch 43 receives voltages for each channel, and outputs the voltages on application of a load control signal.

The operation of the LCD driver will now be described.

As shown in FIG. 2, once the direction of the shift of the R, G and B data is determined by the shift register 31, the first latch 33 stores the R, G and B data in the 240 channels upon the application of the load signals LP1 to LP80 which are outputted sequentially by the shift register 31. The bit converter 35 receives the R, G and B data from the first latch 33 and shifts the voltages of each data to the voltage range of 0 to 12 volts.

When the load signal LP1 outputted by the shift 1 is applied to the MUX 37, the switching devices 51-1, 51-2 and 51-3 of the MUX 37 connected to channels 1, 2 and 3, respectively, are enabled, thus outputting the R, G and B data. The switching devices 51-4, 51-5 and 51-6 connected to the channels 4, 5 and 6, respectively, are enabled on application of the load signal LP2 from the shift 2, thus outputting the R, G and B data. The switching devices 51-238, 51-329 and 51-240 connected to the channels 238, 239 and 240, respectively, are enabled on application of load signal LP80 from the shift 80, outputting the R, G and B data. The decoder 39 selectively outputs one of the 128 analog voltages outputted by the R-ladder 47 corresponding to each output of the MUX 37. Since the MUX 37 sequentially outputs signals, the decoder 39 selects and outputs voltages sequentially.

The MUX 37 outputs the R, G and B data 80 times, and the decoder 39 outputs one of the 128 analog voltages in response to each output of the MUX 37 80 times. The DEMUX 41 sequentially demultiplexes the voltages outputted by the decoder 39 and outputs them to the second latch 43. The second latch 43 stores the output voltages of the DEMUX 41 in the capacitors C1 to C240. If the MOS transistors 71-1 to 71-240 are simultaneously turned on upon application of the load control signal, the voltages stored in the capacitors C1 to C240 are simultaneously outputted to an output buffer 45. Outputs of the output buffer 45 are sent to corresponding pixels of the LCD panel upon application of a gate signal from a gate driver (not shown), thus displaying an image on the LCD panel.

As described above, the LCD driver of the present invention reduces size and complexity of the DACs since only one DAC is used for a pair of channels. In addition, decoding is sequentially performed with respect to all the channels, rather than in parallel, thus reducing power consumption of the decoder 39.

It will be apparent to those skilled in the art that various modifications and variations can be made in the LCD driver of the present invention without departing from the spirit or scope of the invention. Thus, it is intended that the present invention cover the modifications and variations of this invention provided they come within the scope of the appended claims and their equivalents.

What is claimed is:

1. A liquid crystal display driver, comprising:

a shift register for shifting stored R, G and B data and outputting load signals;

a first latch having a plurality of channels for holding and outputting the R, G and B data;

a bit converter for converting a number of bits of each R, G and B data outputted from the first latch;

a multiplexer for selectively passing voltages outputted by the bit converter upon application of the load signals outputted by the shift register;

a decoder for selecting and sequentially outputting an externally supplied voltage in response to an output of the multiplexer;

a demultiplexer for demultiplexing output signals of the decoder upon application of the load signals;

a second latch for storing and outputting output signals of the demultiplexer; and an output buffer for transmitting output signals of the second latch to a liquid crystal display panel.

2. The liquid crystal display driver of claim 1, wherein the multiplexer includes a plurality of switching devices, and wherein output terminals of two adjacent switching devices of the plurality of switching devices are connected to each other.

3. The liquid crystal display driver of claim 2, wherein the R data is applied to a first plurality of adjacent pairs of switching devices, the G data is applied to a second plurality of adjacent pairs of switching devices, and the B data is applied to a third plurality of adjacent pairs of switching devices, and wherein the first, second, and third plurality of adjacent pairs of switching devices are interlaced.

4. The liquid crystal display driver of claim 2, wherein the switching devices include P-metal oxide semiconductor transistors or N-metal oxide semiconductor transistors.

5. The liquid crystal display driver of claim 1, wherein the shift register outputs the load signals to the first latch, the bit converter, the multiplexer, and the demultiplexer.

6. The liquid crystal display driver of claim 1, wherein the bit converter converts a first plurality of digital data corresponding to voltages in a range of 0 to 5V to a second plurality of digital data corresponding to voltages in a range to of 0 to 12V.

7. The liquid crystal display driver of claim 1, wherein the demultiplexer demultiplexes outputs of the decoder in response to the load signals of the shift register.

8. The liquid crystal display driver of claim 1, wherein the demultiplexer includes a plurality of switching devices, and wherein input terminals of two adjacent switching devices are connected to each other.

9. The liquid crystal display driver of claim 8, wherein the switching devices include P-metal oxide semiconductor transistors or N-metal oxide semiconductor transistors.

10. The liquid crystal display driver of claim 1, wherein the second latch stores output signals of the demultiplexer upon application of the load signals.

11. The liquid crystal display driver of claim 1, wherein the second latch includes a plurality of switching devices and a plurality of capacitors, wherein each of the plurality of capacitors is connected to an input terminal of one of the plurality of switching devices in parallel and holds one of the output signals of the demultiplexer.

12. The liquid crystal display driver of claim 1, wherein the multiplexer sequentially outputs voltages of the R, G and B data through three output terminals upon application of the load signals.

13. The liquid crystal display driver of claim 1, wherein the decoder selects and outputs voltages in response to the output signals of the multiplexer through three output terminals upon application of the load signals.

14. A liquid crystal display driver, comprising:

a shift register outputting a plurality of load signals;

a first latch having a plurality of channels for loading R, G and B data into a corresponding one of the plurality of channels upon application of one of the plurality of load signals;

a bit converter for converting a number of bits of the R, G and B data of the plurality of channels inputted from the first latch upon application of one of the plurality of load signals and having a plurality of bit converter outputs;

a multiplexer for multiplexing the plurality of bit converter outputs and having a first multiplexer output corresponding to the R data, a second multiplexer output corresponding to the G data, and a third multiplexer output corresponding to the B data;

a decoder for outputting a first analog voltage corresponding to the first multiplexer output, a second analog voltage corresponding to the second multiplexer output, and a third analog voltage corresponding to the third multiplexer output;

a demultiplexer for demultiplexing the first, second, and third analog voltages upon application of the plurality of load signals and having a plurality of demultiplexer outputs; and a second latch for storing the plurality of demultiplexer outputs.

15. The liquid crystal display driver of claim 14, further including an R-ladder for supplying a plurality of reference voltages to the decoder.

16. The liquid crystal display driver of claim 14, further including an output buffer, wherein the second latch outputs the plurality of demultiplexer outputs to the output buffer, and wherein the output buffer outputs the plurality of the demultiplexer outputs to an LCD panel.

17. The liquid crystal display driver of claim 14, wherein the R, G, and B data are 6 bits wide.

18. The liquid crystal display driver of claim 14, wherein the bit converter converts 6-bit data to 13-bit data.

19. The liquid crystal display driver of claim 14, wherein the decoder outputs voltages in a range of 0 to 12 volts.

* * * * *